US006363701B1

(12) United States Patent
Jacumin

(10) Patent No.: US 6,363,701 B1
(45) Date of Patent: Apr. 2, 2002

(54) FABRIC DETWISTER CYLINDER APPARATUS

(76) Inventor: Jimmy R. Jacumin, 3690 Miller Bridge Rd., Connelly Springs, NC (US) 28612

( * ) Notice: Subject to any disclaimer, the term of this patent is extended or adjusted under 35 U.S.C. 154(b) by 0 days.

(21) Appl. No.: 09/470,749

(22) Filed: Dec. 23, 1999

(51) Int. Cl.[7] ..... D06C 3/00
(52) U.S. Cl. ..... 57/1 UN; 26/71
(58) Field of Search ..... 57/1 UN, 2.3, 57/31, 75, 76, 344, 346, 352, 353; 26/71, 80, 85, 84, 81, 51, 51.3; 28/142, 271

(56) References Cited

U.S. PATENT DOCUMENTS

| | | | | | |
|---|---|---|---|---|---|
| 140,320 | A | | 6/1873 | Tompkins | |
| 679,425 | A | * | 7/1901 | Kertesz | 26/99 |
| 1,181,789 | A | * | 5/1916 | Morley | 26/71 |
| 2,117,603 | A | | 5/1938 | Dungler | |
| 2,248,962 | A | | 7/1941 | Cook | |
| 2,350,071 | A | | 5/1944 | Shields | |
| 2,836,012 | A | | 5/1958 | Moorhouse et al. | |
| 2,881,582 | A | * | 4/1959 | Robbins | 57/2.3 |
| 3,334,481 | A | * | 8/1967 | Peterson et al. | 57/77.3 |
| 3,473,314 | A | * | 10/1969 | Braaten | 57/106 |
| 3,501,818 | A | | 3/1970 | Heitkamp | |
| 3,693,336 | A | | 9/1972 | Bassani | 57/1 |
| 3,813,862 | A | | 6/1974 | Tsuchida | 57/1 |
| 4,241,570 | A | | 12/1980 | Edinger et al. | 57/1 |
| 4,266,983 | A | | 5/1981 | Laszlo et al. | 134/21 |
| 4,286,428 | A | | 9/1981 | Bassani | 57/1 |
| 4,843,669 | A | | 7/1989 | Koch et al. | 8/151 |
| 5,119,646 | A | | 6/1992 | Jacumin | 68/13 |
| 5,271,131 | A | | 12/1993 | Jacumin | 26/87 |
| 5,309,613 | A | * | 5/1994 | Strahm | 26/27 |
| 5,442,842 | A | | 8/1995 | Nielsen et al. | 26/80 |
| 5,551,133 | A | | 9/1996 | Ferraro | 26/80 |
| 5,666,704 | A | | 9/1997 | Price et al. | 26/74 |
| 5,718,107 | A | | 2/1998 | Catallo | 57/1 |
| 5,884,377 | A | * | 3/1999 | Rutz et al. | 26/80 |
| 5,918,353 | A | | 7/1999 | Jacumin | 26/71 |
| 6,047,452 | A | * | 4/2000 | Caruso | 26/80 |

FOREIGN PATENT DOCUMENTS

| | | |
|---|---|---|
| GB | 340123 | 12/1930 |
| GB | 677647 | 7/1950 |

* cited by examiner

*Primary Examiner*—Amy B Vanatta

(57) ABSTRACT

A fabric detwister cylinder apparatus is presented which will accommodate tubular fabrics having different dimensions without exchanging or replacing the detwister cylinder. The insert is placed within a standard detwister cylinder and is rigidly affixed thereto. A sinuous shape of the insert allows fabrics of various sizes to be sufficiently, frictionally engaged during process for imparting the required detwisting action thereto.

12 Claims, 4 Drawing Sheets

FABRIC DETWISTER CYLINDER APPARATUS

FIELD OF THE INVENTION

The invention herein pertains to fabric detwisting apparatus and particularly pertains to detwisting apparatus as used for continuously processing tubular knitted fabrics.

DESCRIPTION OF THE PRIOR ART AND OBJECTIVES OF THE INVENTION

Continuous fabric detwisting is old and well-known in the textile industry whereby, for example tubular knitted fabrics are processed as seen in my earlier U.S. Pat. No. 5,918,353. Detwisting tubular fabrics may be required between a bleaching kier and washing, padding, drying and various other operations by utilizing a rotatable cylinder which will engage the tubular fabric and rotate it in either a clockwise or counterclockwise direction as required to prevent the fabric from knotting or kinking as it is processed. Such tubular knitted fabric is introduced into a cylinder detwisting apparatus whereby compressed air fills and expands the tubular fabric so that it impinges the interior wall of the cylinder. Frictional engagement between the inner cylinder walls and the tubular fabric causes the fabric to be twisted (or detwisted) as the cylinder rotates.

In such prior art fabric detwisting devices as mentioned above the inner walls of the detwister cylinder are sized to accommodate the external diameter of the tubular fabric in an expanded posture so sufficient frictional contact is made to engage the moving fabric. Hence, the cylinder must have a proper diameter so its inner walls will sufficiently contact the expanded tubular fabric. Should the cylinder have too great of a diameter, then little if any twisting action will be applied to the tubular fabric. Should tubular fabric be formed having a diameter substantially smaller than the diameter of the detwister cylinder, then the detwisting equipment would have to be replaced or the cylinder replaced with one of smaller diameter at great cost, requiring expensive labor with equipment and manufacturing down time.

Thus, with the problems and disadvantages associated with prior art fabric detwisters, the present invention was conceived and one of its objectives is to provide a detwister which will accommodate a variety of tubular fabric diameters.

It is still another objective of the present invention to provide an insert for placing within a conventional fabric detwister cylinder to accommodate a variety of tubular fabric diameters.

It is still another objective of the present invention to provide a fabric detwister cylinder insert which includes an inner sinuous cylindrical wall.

Various other objectives and advantages of the present invention will become apparent to those skilled in the art as a more detailed description is set forth below.

SUMMARY OF THE INVENTION

The aforesaid and other objectives are realized by providing an insert for affixing interiorly of a conventional fabric detwister cylinder. The insert is sinuously shaped to provide sufficient frictional engagement with various diameter tubular fabrics passing therethrough. As relatively large diameter tubular fabric pass through the insert, the entire inner insert wall is contacted by the tubular fabric. When a smaller diameter tubular fabric is introduced, only the innermost portions of the sinuously shaped inner walls are impinged. However, sufficient frictional engagement is achieved to properly rotate or detwist the fabric as required. The insert is in axial alignment with the outer conventional cylinder and may extend the entire longitudinal distance of the outer or standard cylinder.

DETAILED DESCRIPTION OF THE PREFERRED EMBODIMENT AND OPERATION OF THE INVENTION

Figure 1:
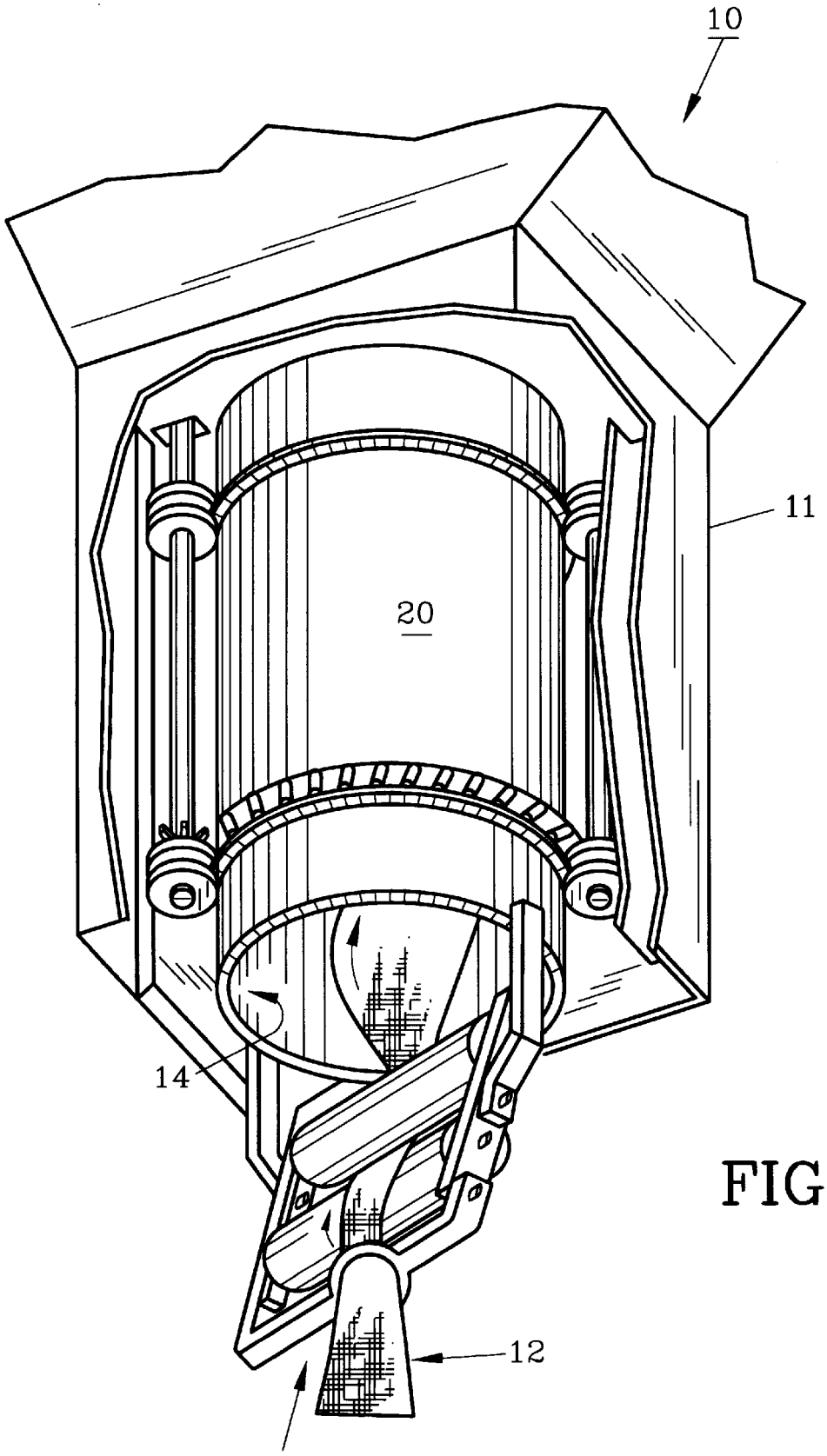
FIG. 1 demonstrates a perspective view of a conventional fabric detwister cylinder with the cylinder housing partially cut-away.

Turning now to the drawings, FIG. 1 shows a partial cut-away view of conventional continuous fabric detwister 10 with standard cylinder 20 in place for imparting a twist to tubular fabric 12 entering from below. Tubular fabric 12 may be for example a knitted polymeric fabric which is sized to expand and impinge inner walls 14 of cylinder 20 whereby cylinder 20 can apply rotational action to tubular fabric 12 as is usual in the industry.

Figure 2:
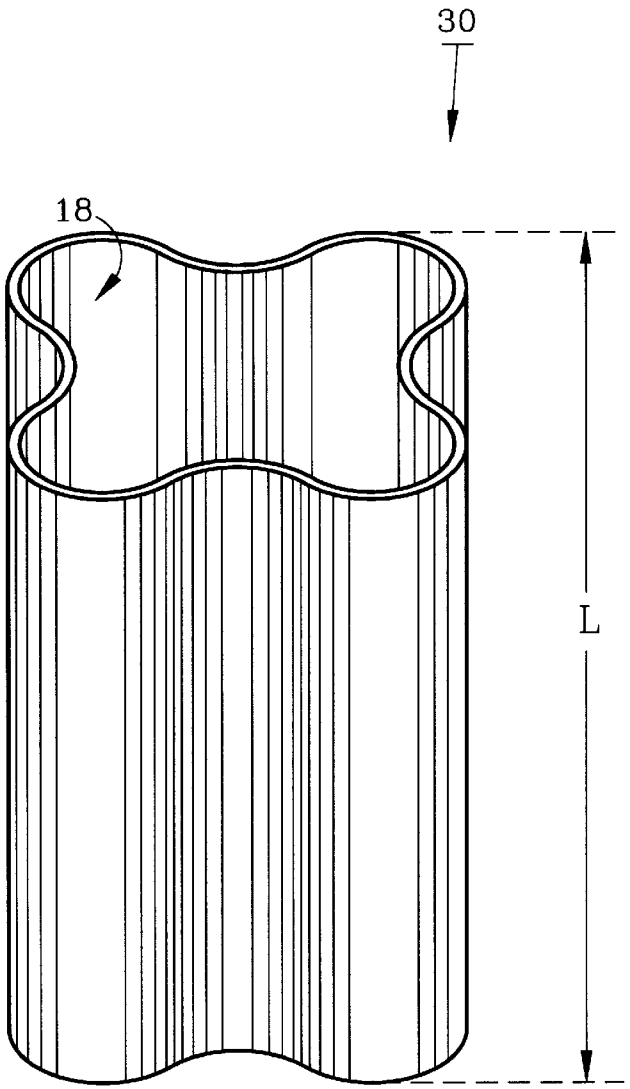
FIG. 2 shows a perspective view of one embodiment of the detwister cylinder insert of the invention removed from the conventional detwister cylinder.

Insert 30 as shown in FIG. 2 is sinuously shaped uniformly alone its longitudinal axis L and is preferably affixed within for example, cylinder 20 as shown in FIG. 1 with bolts, screws, weldments or other suitable fastening means (not seen). Insert 30 is the preferred form of the invention having a shamrock-like appearance and is made from a suitable metal as are standard detwister cylinders. Inner walls 18 of insert 30 are uniform along its longitudinal length as seen in FIG. 2.

Figure 3:
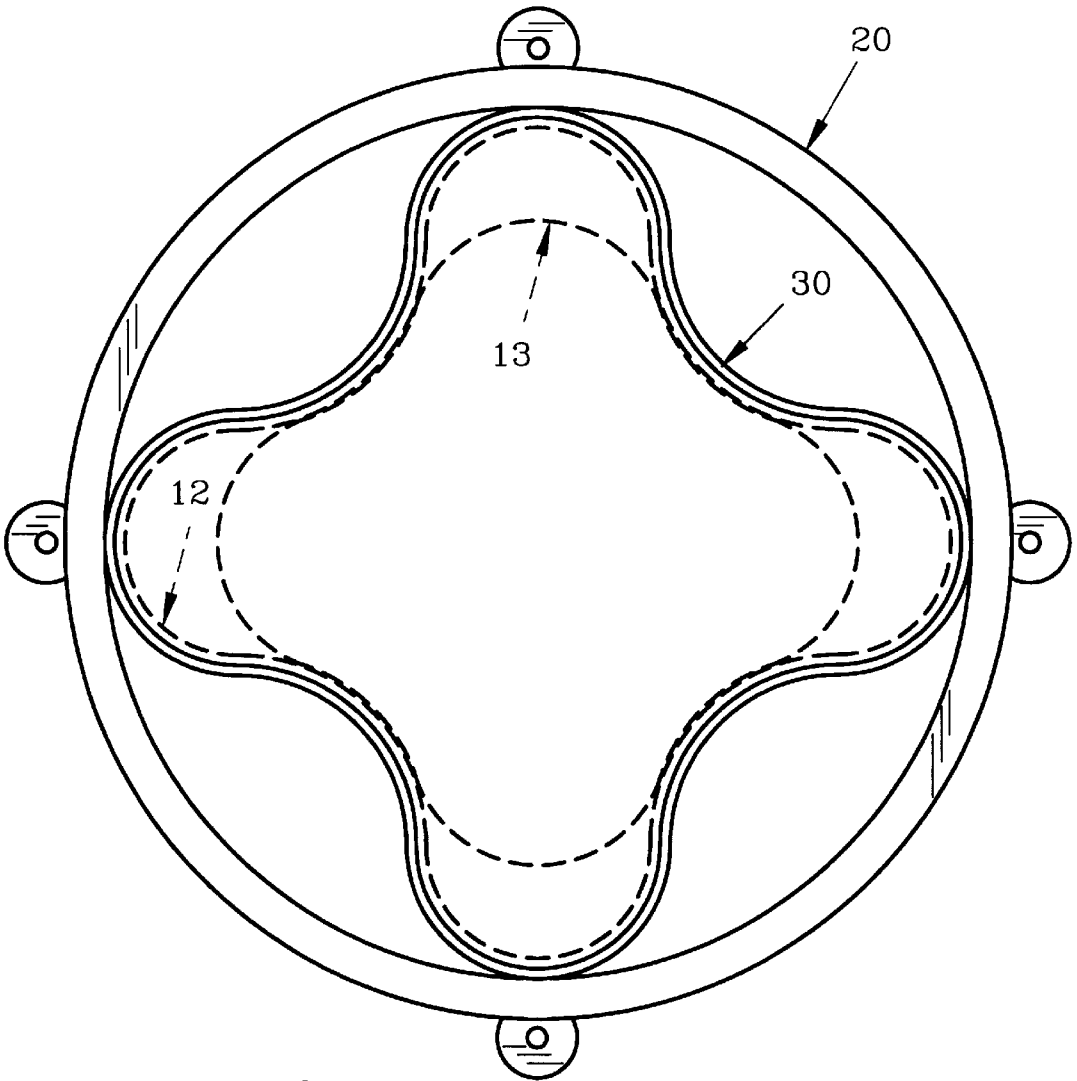
FIG. 3 depicts a top view of the sinuous cylinder insert of FIG. 2 in place in a standard detwister cylinder.

As seen in FIG. 3, preferred insert 30 is rigidly affixed within detwister cylinder 20 for rotation therewith. Insert 30 is sized to receive large diameter tubular fabric 12 and can sequentially accommodate a smaller diameter tubular fabric 13, both shown in ghost fashion. As would be understood, air jets, activators, sensors and other mechanical, pneumatic and/or electrical components of continuous fabric detwister 10 are not generally shown herein and are conventional in the trade.

Insert 30 could be used as a stand alone detwister cylinder, if desired with standard detwister 20 removed, provided mechanical modifications are made for imparting rotational movement thereto, such being within the ordinary skill of one in the art.

Figure 4:
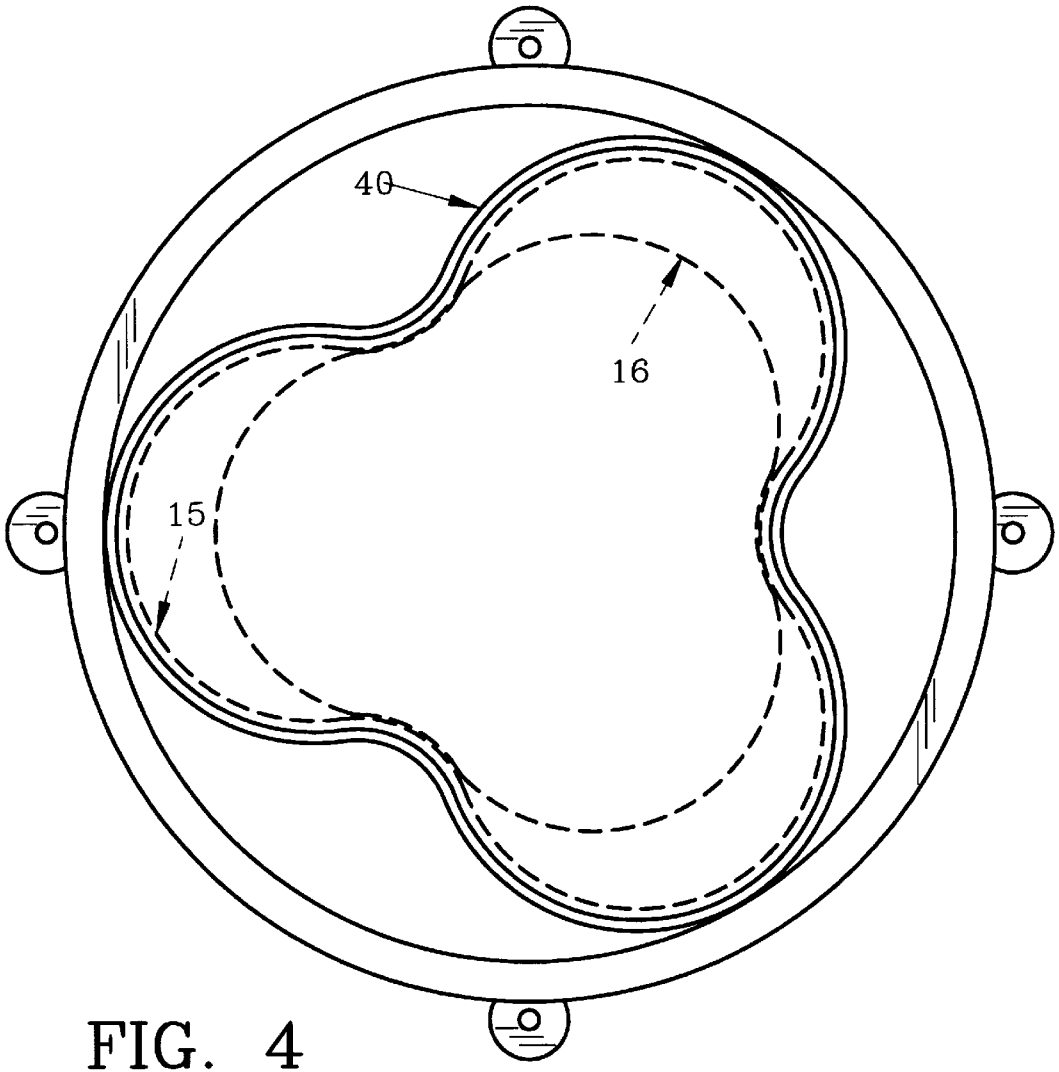
FIG. 4 illustrates another embodiment of the sinuous detwister cylinder insert also in a standard detwister cylinder.

FIG. 4 demonstrates a top view of an alternate embodiment of the insert as shown in FIGS. 2 and 3 whereby insert 40 also has a sinuous shape. The sinuous shape of insert 40 describes a clover-like configuration which will accommodate a large diameter tubular fabric 15 or a smaller diameter tubular fabric 16, both seen in ghost fashion. As would be understood, insert 40 is rigidly affixed to standard detwisting cylinder 20 as described above for insert 30, to rotate with cylinder 20 for imparting a twisting action to the particular fabric being processed. Thus, either tubular fabric 15 or 16 can be detwisted in sequence without the need of changing the detwisting cylinder, thus saving time and labor costs.

While a cylinder insert is shown to illustrate the preferred embodiment, a standard detwisting cylinder could be replaced with a cylinder having a sinuous shape of the depicted inserts. Thus, the illustrations and examples provided herein are for explanatory purposes and are not intended to limit the scope of the appended claims.

I claim:

1. In a tubular fabric detwister cylinder having an inner wall for engaging the external diameter of an expanded fabric tube passing therethrough to twist the same, the improvement comprising: an insert, said insert affixed interiorly of said detwister cylinder, said insert comprising an inner sinuous wall, said insert for engaging the external diameter of various diameter expanded tubular fabrics to twist the fabrics during engagement therewith as said cylinder rotates.

2. The improvement of claim 1 wherein said sinuously shaped insert is uniform along its longitudinal axis.

3. The improvement of claim 1 wherein said sinuously shaped insert defines a shamrock-like appearance.

4. The improvement of claim 1 wherein said sinuously shaped insert defines a clover-like appearance.

5. In a fabric detwister for tubular fabrics, said detwister having a cylinder with an inner wall for engaging the outer surface of an expanded tubular fabric, the improvement comprising: a cylinder insert, said insert affixed interiorly of said detwister cylinder, said insert comprising a sinuous inner wall for engaging expanded tubular fabrics of various diameters passing therethrough to twist the same during engagement therewith.

6. The improvement of claim 5 wherein said insert is uniform in diameter along its longitudinal axis.

7. The improvement of claim 6 wherein said insert defines a shamrock-like appearance.

8. The improvement of claim 6 wherein said insert defines a clover-like appearance.

9. A tubular fabric detwister cylinder for engaging expanded tubular fabrics passing therethrough, said cylinder for accommodating tubular fabrics of various expanded diameters, said cylinder comprising a sinuous inner wall, said inner wall for engaging the external diameter of the tubular fabrics for imparting a twisting action thereto.

10. The fabric detwister cylinder of claim 9 formed from metal.

11. The tubular fabric detwister cylinder of claim 9 wherein said sinuous inner wall is uniform along its length.

12. The tubular fabric detwister cylinder of claim 9 wherein a larger diameter expanded tubular fabric is engaged by the outermost portions of said sinuous inner wall and a smaller diameter fabric is engaged by the innermost portions of said sinuous inner wall.

* * * * *